United States Patent [19]

Campbell

[11] Patent Number: 4,985,657

[45] Date of Patent: Jan. 15, 1991

[54] HIGH FLUX ION GUN APPARATUS AND METHOD FOR ENHANCING ION FLUX THEREFROM

[75] Inventor: Charles T. Campbell, Bloomington, Ind.

[73] Assignee: LK Technologies, Inc., Bloomington, Ind.

[21] Appl. No.: 336,371

[22] Filed: Apr. 11, 1989

[51] Int. Cl.[5] ..... H01J 27/02

[52] U.S. Cl. ..... 313/362.100; 250/424; 315/111.91

[58] Field of Search ..... 313/362.1, 359.1, 230, 313/231.41; 315/111.21, 111.71, 111.91; 250/423 R, 424, 425

[56] References Cited

U.S. PATENT DOCUMENTS

| | | | |
|---|---|---|---|
| 3,527,937 | 9/1970 | Delany et al. | 250/41.9 |
| 3,557,365 | 1/1971 | Mayo et al. | 250/41.9 |
| 4,122,347 | 10/1978 | Kovalsky et al. | 250/423 R |
| 4,142,958 | 3/1979 | Wei et al. | 204/192 P |
| 4,250,009 | 2/1981 | Cuomo et al. | 204/192 N |
| 4,296,323 | 10/1981 | Gerlach | 250/289 |
| 4,351,712 | 9/1982 | Cuomo et al. | 204/192 EC |
| 4,381,453 | 4/1983 | Cuomo et al. | 250/398 |
| 4,411,733 | 10/1983 | Macklin et al. | 156/643 |
| 4,419,203 | 12/1983 | Harper et al. | 204/192 R |
| 4,450,031 | 5/1984 | Ono et al. | 156/345 |
| 4,486,286 | 12/1989 | Lewin et al. | 204/192 C |
| 4,491,735 | 1/1985 | Smith | 250/423 R |
| 4,506,160 | 3/1985 | Sugawara et al. | 250/427 |
| 4,521,719 | 6/1985 | Liebel | 315/111.81 |
| 4,546,253 | 10/1985 | Tsuchiya et al. | 250/288 |
| 4,588,490 | 5/1986 | Cuomo et al. | 204/298 |
| 4,641,031 | 2/1987 | Ito et al. | 250/423 R |
| 4,659,899 | 4/1987 | Welkie et al. | 219/121 PN |
| 4,661,702 | 4/1987 | Welkie | 250/309 |
| 4,692,230 | 9/1987 | Nihei et al. | 204/192.31 |
| 4,739,214 | 4/1988 | Barr | 313/362.1 |
| 4,749,912 | 6/1988 | Hara et al. | 313/362.1 X |
| 4,755,344 | 7/1988 | Friedman et al. | 313/362.1 X |

OTHER PUBLICATIONS

Physical Electronics—12/1988, Surface Analysis Components Catalog, Perkin-Elmer Catalog, pp. 75–79.

*Primary Examiner*—Kenneth Wieder

*Attorney, Agent, or Firm*—Lowe, Price, LeBlanc, Becker & Shur

[57] ABSTRACT

The ion flux obtainable from an otherwise conventional ion source, to project a controlled ion beam at a target contained within an evacuated target chamber, is significantly enhanced by providing a flow of an ionizable gas directly into the ion source canister instead of being supplied into the target chamber. Flux enhancement values exceeding an order of magnitude may thus be obtained with ionizable gases such as argon, helium and neon. The highly enhanced ion flux is particularly advantageous for applications such as sputtering and ion scattering spectroscopy (ISS).

17 Claims, 1 Drawing Sheet

HIGH FLUX ION GUN APPARATUS AND METHOD FOR ENHANCING ION FLUX THEREFROM

FIELD OF THE INVENTION

This invention relates to an ion gun that provides a controlled beam of ionized gas particles directable to a target and, more particularly, to an ion gun with a high ion flux suitable for applications involving ion sputtering and to a method for enhancing the ion flux from an otherwise conventional ion source.

FIELD OF THE INVENTION

There are numerous manufacturing processes, particularly in the manufacture of solid state circuits and electronic components, in which a carefully controlled beam of ionized particles, preferably positively charged ions of a selected gas, is directed to the surface of a target of a selected material, e.g., for cleaning the same. In another common application the ion beam may be directed at the target, now acting as a source of a selected material, to cause atoms of that material, from the source/target, to be released for deposition elsewhere. The latter process, commonly referred to as sputtering, generally involves a low pressure gas, generally selected from a group of gases including argon, helium and neon, directed through an ion source to be ionized therein, after which the charged gas ions are electrostatically accelerated by an electric field toward the target.

Preferred source gases for generating such an ionized beam, sometimes referred to as a plasma, include normally nonreactive gases such as argon, helium and neon. In the sputtering process, when such gas ions impact on the target or source, they dislodge atoms off the source material and these may be further accelerated by appropriately designed electrodes toward the surface to be coated, typically a substrate in the formation of a solid state element or circuit. Alternatively, the sputtered atoms may be formed into a separate focused beam for particular use. The target or source is often made a cathode in a circuit and may be heated to further assist the release of target, species atoms when exposed to the gas plasma or ion beam For sputtering and other similar applications, an evacuated target chamber is provided to enclose therewithin a target or source suitably located with respect to an ion source from which the ion beam is projected on to the target. Various electrical connections are made, in conventional manner, to appropriately charge the target chamber (which is normally grounded) with respect to the target or source (also normally grounded) and various portions of the ion source.

Among the numerous devices and techniques taught in the relevant prior art, U.S. Pat. No. 4,692,230 to Nihei et al discloses a sputtered coating device including a differential exhausting device for maintaining a desired pressure differential between a main portion of a target chamber and the interior of a canister surrounding the ion source. This reference does not appear to teach any specifics regarding the relative gas pressures within the ion source and target chamber in the volume outside the ion source.

U.S. Pats. No. 4,250,009 by Cuomo et al, No. 4,486,286 by Lewin, and No. 4,491,735 by Smith, all disclose ion sources that include means for directly introducing the ionizable gas into a discharge chamber where the ions are to be formed therefrom. Differences between the teaching of these references and the current invention include the mode of ion formation, the corresponding ion source gas pressure required for ion formation, and the size of the orifice through which ions flow between the ion source canister and the target chamber.

In all these known devices, the ions are formed by an RF or DC discharge, rather than by electron impact from an electron source filament as in the present invention. A well-known advantage of the electron impact method for generating ions is in relative simplicity and low cost of construction of the total ion source (including its electronics). In order to maintain these discharges according to the above-cited references, a relatively high pressure of the gas is required in the discharge region where the gas is to be ionized ($\sim 10^{-3}$–10 torr). This is a much higher pressure than is required or typically employed in the source region of devices which utilize electron impact ionization ($10^{-8}$–$5\times10^{-5}$ torr) Because of the higher pressures required, devices based on RF or DC discharges frequently employ a very small orifice ($\sim$1–1000 micrometers) through which the ions pass between the discharge region where they are formed and the target at which they are aimed. The target chamber is separately pumped, so that a substantial pressure gradient develops between the ion source canister and the target chamber due to the constriction of gas flow by the very small orifice therebetween. However, as is well known, the pressure gradient across any such orifice decreases drastically as the orifice diameter increases and as the pressure in the source region decreases. See, for example, "Scientific Foundations of Vacuum Techniques", by Dushman, S., Lafferty, J. M., ed. (2d. ed.), John Wiley and Sons, N.Y., 1962).

By contrast, ion sources based on electron impact from a hot filament require a much larger orifice ($\sim$1 cm) and a lower pressure in the ionization region ($\sim 10^{-8}$–$10^{-4}$ torr) than described in these references. With the electron impact ionization technique, a useful pressure gradient can be readily maintained between the ion source canister and a typical target chamber. In the present invention employing impact ionization, the gas is introduced directly into the source canister where ionization is provided by impact of electrons produced at a filament with neutral source gas atoms, while a useful pressure gradient is maintained between the source canister and the target.

In apparatus of the type described in the above-cited references, and as is common in utilizing ion beams or electron beams, it is also known to provide a beam-focusing lens that is generally of cylindrical form and is suitably charged, as well as beam deflection plates usually disposed in two orthogonally disposed pairs each member of which is separately charged to generate a composite electrostatic field capable of rapidly deflecting the charged particle beam that is to be controlled.

For certain applications, sputtering being one, it is highly desirable, having selected an ionizable gas, to obtain a relatively high flux, i.e., a high rate of transfer of ionized gas particles from the ion source to the target surface per square area thereof per unit of time with a low rate of consumption (load) of the gas. The improvement taught and claimed herein is intended to and has been shown to enhance the ion beam flux from otherwise conventional ion sources by more than an order of magnitude over known techniques through the provision of a simple inlet tube for controllably introducing an ion source gas into an electron impact type of ion source canister which is mounted as usual within a target chamber.

SUMMARY OF THE DISCLOSURE

Accordingly, it is an object of this invention to provide an improved filament type electron impact ion source for obtaining a high flux ion beam therefrom.

It is another object of this invention to provide an ion source apparatus provided with a controlled flow of a gas for ionization therein in a manner that promotes the generation of a high flux ion flow therefrom.

It is a related object of this invention to provide a method for enhancing the ion flux of an ion beam emanating from an otherwise conventional ion source apparatus.

It is a further related object of this invention to provide a method for sputtering selected atoms from a source thereof by directing thereto a high flux ion beam utilizing a selected gas to generate a beam of controllably directed ions.

These and other related objects of the present invention are realized by providing apparatus and a method for directing a flow of a selected ionizable gas directly into a filament-type electron impact ion source, contained within an evacuated chamber, to generate an ion flux therefrom and regulating this flow of ionizable gas such that a partial pressure of the ionizable gas inside the ion source is maintained higher than a partial pressure of the ionizable gas outside the ion source but still within the evacuated chamber while the ion flux is being generated. Focusing of the enhanced ion flux into an ion beam and rastering thereof across a target surface are accomplished by known means and techniques.

Still other objects and advantages of the present invention will become readily apparent to those skilled in this art from the following detailed description, wherein only the preferred embodiments of the invention are shown and described, simply by way of illustration of the best modes contemplated of carrying out the invention. As will be realized, the invention is capable of other and different embodiments, and its several details are capable of modifications in various obvious respects, all without departing from the invention. Accordingly, the drawing and description hereof are to be regarded merely as illustrative in nature and not as restrictive, the invention being defined solely by the claims appended hereto.

DESCRIPTION OF THE PREFERRED EMBODIMENTS

Figure 1:
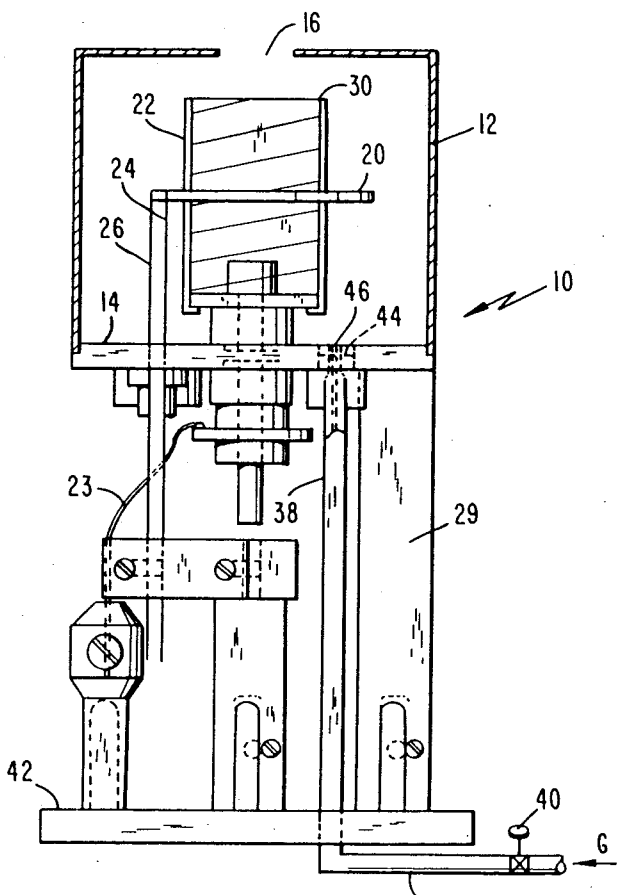
FIG. 1 is a partially sectioned view of the main components of an ion source according to a preferred embodiment of this invention.

The typical ion gun is a device for producing an ion beam from a selected gas and for directing the ion beam to a selected target. In normal use, such an ion gun is placed within the same evacuated volume as the target, within what is commonly known as a target chamber. The shape and the size of this target chamber, as well as that of the target, will necessarily vary with the application at hand. Referring now to FIG. 1, a typical ion gun 10, such as for example the Perkin Elmer 04-162, includes a hot filament 20 which acts as an electron source for electron-impact ionization of selected gas molecules housed within a barrel-shaped ion source canister 12 that is insulatedly mounted on a base or flange 14. An ion exit aperture 16 is normally provided in an end wall of the source canister 12 between the ionizing means and the target 18, so that a controlled flow of ionized gas atoms or molecules may pass therethrough from the source canister 12 to the target 18 across the volume of space therebetween. This is better understood with reference to FIG. 2, in which target 18 is seen disposed in known manner at a predetermined distance from aperture 16.

Figure 2:
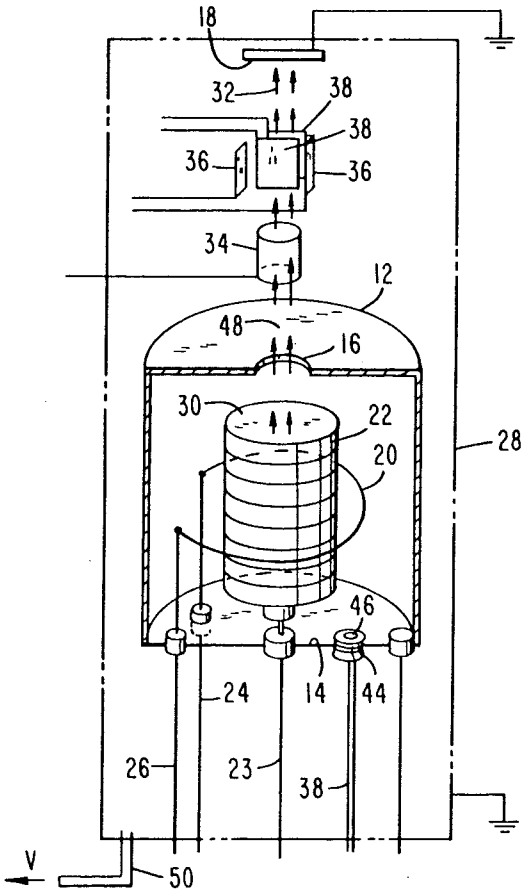
FIG. 2 is a partial sectional view of an ion source according to a preferred embodiment of this invention in an application utilizing ion beam focusing and rastering over a target mounted inside a target chamber.

The ionizing means of electron impact from a hot filament 20 has been widely used for many decades in ion guns, mass spectrometers and ion gauges. The generally known structure also involves the filament 20, commonly comprising thoria-coated iridium, mounted in a circular geometry so thaty it is concentric with and surrounding a metallic wire grid generally formed as a barrel shaped ion cage 22. This filament is generally concentric with and inside the source canister as indicated in FIG. 2.

The individual electrical voltages applied to the source canister 12, to the two ends of filament 20, i.e., to electrical leads 24 and 26, as well as to the ion cage 22 are all separately controllable. They require four electrical connections insulatedly guided through a wall of a target chamber 28 enclosing the ion source and the target and connected to an external power supply (not shown) in known manner.

The entire ion gun 10 and the various electrical connections are easily mounted, as best seen in FIG. 1, by one or more supports 29 extending from a typical copper gasket sealed flange 42 bolted to the bottom of target chamber 28.

The process of generating gas ions with this type of ion source has been well known for decades. Electrons are generated at the hot filament 20 which is heated by applying an AC or DC voltage across the ends of filament 20. Electrons are released from the thoria-covered surface of filament 20 and become available to be directed electrostatically in a manner described more fully hereinafter. The target 18 and the target chamber 28 walls are all typically maintained at ground potential, i.e., 0 volts. Commensurately, ion cage 22 is maintained at a relatively large positive DC voltage, preferably in the range 400 to 5000 volts, via electrical lead 23, with respect to ground.

The filament 20 is maintained at a nominal negative DC voltage, preferably in the range 50 to 200 volts, with respect to the ion cage 22, so that electrons generated at the hot filament 20 are accelerated toward and into the more positively charged ion cage which has an open grid structure and permits free entry and exit of such electrons. The ion source canister walls, i.e., 12, are maintained at a nominal negative DC voltage, preferably in the range 50 to 200 volts, with respect to filament 20. Therefore, the electrons on passing completely through the ion cage 22 are repelled by the (relatively) negatively charged canister walls 12 and return through the openings in ion cage 22. In this manner, they can make many passes through the ion cage 22.

As persons skilled in the art will appreciate, this highly energetic motion of negatively charged electrons within ion source canister 12 is bound to result in collisions between the electrons and neutral gas particles present therein. Therefore, any neutral gas atoms that are present in the ion cage 22 have a significant probability of encountering one of these highly energetic, fast-moving electrons and thereby becoming ionized by interaction therewith. In this manner, numerous neutral gas particles become positively charged ions intermixed with the moving electrons and, likewise, becoming amenable to guided motion by the imposition of electrical fields provided by carefully selected electrical voltage differences in or near the source of such ionized gas atoms.

The negative voltage applied on the source canister 12 (relative to the ion cage) is felt attractively by the positively charged ions that are present near the open end 30 of the ion cage 22. These ions are therefore accelerated out of open end 30 of the ion cage 22 and toward the ion exit aperture 16 in the end wall of source canister 12. Aperture 16 preferably has its center coaxial with that of the barrel-shaped ion cage 22. Some of the positively charged ions produced in the ion cage 22 will thus pass through exit aperture 16 and continue their trajectory along the axis of the ion cage 22. Target 18 is normally located so that its ion-intercepting surface is substantially intersected by the ion cage axis. As best seen with reference to FIG. 2, and indicated therein by a succession of paired arrows, a thus directed stream of ions forms an ion beam 32 directed toward the target. This ion beam 32 is accelerated by the relatively positive DC voltage between the ion source canister 12 and the target 18. Note that the source canister 12 was relatively positively biased with respect to the grounded target 18 for this purpose In known manner, the magnitude of this voltage difference can be controlled to vary the electrostatic acceleration applied to enhance the kinetic energy contained in the ions by the time they actually strike the target 18. Such an ion extractor system has been used with many ion sources and is well known in the art.

In typical ion guns, the gas to be ionized normally enters the source canister 12 by effusion from the target chamber 28 through the aperture 16 in the end wall of the source canister A valve (not shown) is normally provided in the wall of the target chamber for introducing the gas to be ionized from an external reservoir (not shown) into the target chamber. In this way, the respective partial pressures of the gas in the target chamber and the ion source are approximately equal, and can be conveniently monitored with any pressure gauge or mass spectrometer (not shown) available in the target chamber. Since the ion flux produced at the target by such a device increases in a reproducible way as this partial pressure increases up to $\sim 5\times 10^{-5}$ torr, the ion flux to the target can be reproducibly controlled by regulating the flow (and therefore the pressure) of the ionizing gas into the target chamber.

Also well known and generally used are means such as a focusing lens 34, that often has the form of an electrically charged cylinder, for the purpose of focusing the ion beam 32 to a narrow spot onto target 18. In addition, the ion beam 32 may be rastered in known manner, i.e., its impact point on the target may be controllably traversed, across the target by means of paired deflection plates 36 and 38 in known manner. These deflection plates are therefore connected to external sources of electrical voltage to influence motion of the ion beam impact point at target 18 in known manner.

Coming now to the specific improvement offered by the present invention, most conveniently understood with reference to FIGS. 1 and 2, a significant enhancement in the ion flux is obtained according to the preferred embodiment by providing a regulated flow of the gas that is to be ionized directly into the ion canister 12 via a tube 38 and a control valve 40. The partial pressure of that gas which is present in the canister 12 is maintained by gas flow dynamics through aperture 16 to be higher than the pressure of the gas that is in the target chamber 28 in the volume outside the canister 12. This gas flow is delivered conveniently through a small bore tube directed into the interior of canister 12, as best seen with reference to FIG. 2.

Notice that the only possibility for this gas to then leave canister 12 is either as ions or as unionized gas, in both cases through the exit aperture 16. Notice specifically that there are no additional tubes provided on this canister for attaching a separate pump for removing this gas, as is the case in several commercial so-called "differentially-pumped" ion guns based on RF or DC discharge ionization. The gas then enters the target chamber 28, from which it exits through a tube 50 (not shown to scale, but much smaller than in typical applications) connected to a vacuum pump (as indicated by an arrow marked by the letter "V"). Therefore, an element of the improvement according to this invention is the use of the exit aperture 16 of appropriately chosen diameter as a gas flow restriction means as well as an aperture for extracting the ion flux. The pressure differential between the source canister 12 and the target chamber 28 will be directly related to the ratio of the pumping speed of the target chamber to the flow conductance of the gas through aperture 16, according to known principles of gas flow (see the previous cited reference of Dushman et al.). This flow conductance is, in turn, directly related to the diameter of the exit aperture.

Details of entrance tube 38 and control valve 40, which are elements of the improvement according to this invention and as those used in the experiment for regulating delivery of the ionizable gas into the ion source canister 12, are best understood with reference to both FIGS. 1 and 2. In the prototype apparatus, a hole was drilled into the mounting flange 42 of the ion source and a narrow bore stainless steel tube 38 was attached to a standard ultra high vacuum leak valve 40 and welded or brazed to mate with this hole. A gas supply (not shown) containing the selected gas that was to be ionized was connected to an inlet port of the valve 40. A length of this stainless steel tube 38 which passed through flange 42 was then extended up to the base 14 of the ion source. The tubing 38 was mated into a small hole 46 in the canister base 14 through a ceramic adapter 44, made of a commercially available machinable ceramic known as Macor (DM). This adapter 44, which resembles a ceramic shoulder washer for a 1/16 inch bolt, serves as an electrical insulator since the ion source canister 12 typically operates at a relatively high positive voltage, typically around 4000–5000 volts. In this way, the gas which is leaked through valve 40 flows through the flange 42 via the tube 38 and into the canister 12 via the adapter 44 and hole 46.

In experiments conducted with the prototype of the preferred embodiment of this invention, the ion exit aperture 16 on the ion source canister 12 was formed as a circular hole of diameter 0.6 cm. The ion source was mounted in a pre-existing target chamber such that the aperture 16 was approximately 15 cm away from a copper target (diameter = 1.2 cm), and aligned such that the axis of the source canister 12 was aimed at the target through this aperture 16. The target chamber was pumped by a conventional ion pump attached to tube 50 such that the target chamber had a typical overall pumping speed for argon of approximately 150 liters/s. See the previously cited reference of Dushman et al for a definition and calculations of pumping speed.

To test this ion gun, it was used to sputter the target with argon ions. Argon gas was introduced directly into the ion source canister 12 through the tube 38. With optimum voltages on the various components, a 3 KV argon ion beam of flux $3\times10^{12}$ ions/cm$^2$/s at the target was thus generated with a pressure rise of only $1\times10^{-6}$ torr of argon in the target chamber (for a nominal gun to target distance of 14 cm). In order to achieve this same flux by leaking the argon directly into the target chamber as in conventional designs (via a valve not shown), a pressure rise of $5\times10^{-5}$ torr of argon was required. This implies that, when the gas was controllably leaked directly into the canister 12 the local argon pressure inside the canister was approximately fifty-fold higher than in the target chamber. Thus, the present invention, according to such a preferred embodiment thereof, leads to a reduction in the amount of argon gas required for the same amount of scattering by a factor of approximately fifty. Similarly, the time required to pump the target chamber back down to a routine operating pressure of $\sim3\times10^{-10}$ torr was decreased by a factor of about ten due to this decreased gas load, thus improving greatly the system recovery time after argon sputtering. For any fixed argon pressure in the target chamber which was below $\sim10^{-6}$ torr, the ion flux at the target was a factor of approximately fifty larger when the argon was leaked directly into the source canister via the tube 38 than when leaked directly into the target chamber.

When helium (He) was used as the ionizable gas, the pressure rise in the target chamber was 17 times less for the same He ion flux at the sample when the He gas was leaked directly into the ion source via tube 38 as compared to the conventional method of leaking the helium directly into the target chamber 12. This is understood to mean that good quality ion scattering spectroscopy (ISS) spectra can be collected in a few minutes with a helium supply pressure ($P_T$) of only $3\times10^{-8}$ torr, while a pressure greater than $5\times10^{-7}$ torr would have been required without the improvement according to the present invention. Since ion energy analyzers are typically recommended not to be operated above about $2\times10^{-7}$ torr, this turns out to be a critical difference and a very significant advantage over the known art. The energy resolution of the ions from such sputter guns is also quite sufficient for use in most ISS applications. Their energy spread of less than a few electron volts is considerably narrower than the ISS peaks, the widths of which, typically 30 electron volts, are usually determined by the physics of the ion scattering process. The improvement, as taught herein, therefore enhances the range and scope of use of otherwise conventional ion sources with only very minor structural modification in any easy-to-control manner.

In this disclosure, there are shown and described only the preferred embodiments of the invention, but, as aforementioned, it is to be understood that the invention is capable of use in various other combinations and environments and is amenable to changes or modifications within the scope of the inventive concept as expressed herein.

What is claimed:

1. An improvement to a filament-type electron impact ion source that provides within an evacuated target chamber and ion flux directable to a target suitably located therein, wherein the improvement comprises:

means for providing a flow of an ionizable gas directly into said ion source for molecules of the gas to be ionized therein for delivery therefrom of said ion flux; and means for regulating said flow of ionizable gas directly into said ion source and through said ion source into the target chamber such that a first partial pressure of said ionizable gas inside said ion source is maintained higher than a second partial pressure of said gas outside said ion source but still within said target chamber during generation of said ion flux, wherein said regulating means comprises a user-operable flow control valve located between said target chamber and a supply of said ionizable gas.

2. An improved ion source according to claim 1, wherein:

said regulated flow of ionizable gas enters a base of said ion source via an insulated fitting therein.

3. An improved ion source according to claim 2, wherein:

said insulated fitting comprises a ceramic material.

4. An improved ion source according to claim 3, wherein:

said ceramic material comprises Macor TM.

5. An improved ion source according to claim 1, wherein:

said flow control valve is located outside of said target chamber.

6. An improved ion source according to claim 1, further comprising:

means for focusing said ion flux as an ion beam and directing the same at a surface of a target contained within said evacuated target chamber; and means for controllably altering the location at which said ion beam encounters said target surface.

7. An improved ion source according to claim 1, wherein:

said ionizable gas is selected from a group of gases including argon, helium and neon.

8. An improvement to a filament-type electron impact ion source that provides within an evacuated target chamber an ion flux directable to a target suitably located therein, wherein the improvement comprises:

means for providing a flow of an ionizable gas directly into said ion source for molecules of the gas to be ionized therein for delivery therefrom of said ion flux;

means for regulating said flow of ionizable gas directly into said ion source and through said ion source into the target chamber such that a first partial pressure of said ionizable gas inside said ion source is maintained higher than a second partial pressure of said gas outside said ion source but still within said target chamber during generation of said ion flux; and means for focusing said ion flux as an ion beam and directing the same at a surface of a target contained within said evacuated target chamber.

9. An improved ion source according to claim 8, further comprising:

means for controllably altering the location at which said ion beam encounters said target surface.

10. A method of enhancing an ion flux provided by an ion source within an evacuated chamber, comprising the step of:

operating a flow control valve to thereby regulate a flow of an ionizable gas directly into said ion source; and ionizing said ionizable gas in said ion source to generate said ion flux therefrom, said flow being regulated at a rate such that a first partial pressure of said ionizable gas inside said ion source is maintained higher than a second partial pressure of said ionizable gas outside said ion source but still within said evacuated chamber during generation of said ion flux.

11. A method of enhancing an ion flux provided by an ion source within an evacuated chamber, comprising the step of:

regulating a flow of an ionizable gas directly into said ion source, for ionization therein to generate said ion flux therefrom, at such a rate that a first partial pressure of said ionizable gas inside said ion source is maintained higher than a second partial pressure of said ionizable gas outside said ion source but still within said evacuated chamber during generation of said ion flux, wherein said regulating step is effected by operating a flow control valve located between said ion source and a supply of said ionizable gas.

12. The method according to claim 11, wherein:

said ionizable gas is selected from a group of gases including argon, helium and neon.

13. A method of enhancing an ion flux provided by an ion source within an evacuated chamber, comprising the step of:

regulating a flow of an ionizable gas directly into said ion source for ionization therein to generate said ion flux therefrom, at such a rate that a first partial pressure of said ionizable gas inside said ion source is maintained higher than a second partial pressure of said ionizable gas outside said ion source but still within said evacuated chamber during generation of said ion flux, and focusing said ion flux as an ion beam and directly the same at a surface of a target contained within said evacuated chamber.

14. The method according to claim 13, including further step of:

controllably altering the location at which said ion beam encounters said target surface.

15. A method for producing an ion beam from a flow of an ionizable gas, which is directly to a target inside an evacuated chamber, comprising the steps of:

flowing said gas at a controlled rate directly into an ion source:

ionizing said gas in the ion source;

extracting the ions thus produced as an ion flux flowing through an exit aperture in the ion source to form a beam directed at the target;

maintaining a first pressure of said gas in the ion source at a value higher than a second gas pressure at the target due solely to the restriction of gas flow through said exit aperture, said pressures being directly related to the ratio of the pumping speed of the target chamber to the flow conductance of the gas through said aperture; and focusing the ions fluxing form the ion source as a beam of ions onto the target.

16. The method of claim 15, further comprising the additional step of:

deflecting the beam of ions across the target area.

17. The device for producing an ion beam from a gas to impact a target, said target being housed in an evacuated volume, comprising:

a means for ionizing gas molecules housed in a container within the evacuated volume;

an entrance tube means connected to the container for introducing the gas thereto in a controlled flow;

an exit aperture of predetermined size in the container between the ionizing means and the target for extracting the ions therethrough and to allow a restricted flow of gases from the container to the target volume; and a leak value is attached to the entrance tube means to control the gas flow to the ionizing means.

* * * * *